United States Patent [19]

Sakamaki et al.

[11] Patent Number: 4,545,749

[45] Date of Patent: Oct. 8, 1985

[54] VANE-TYPE ROTARY PUMP HAVING TWO-PIECE SIDE HOUSINGS

[75] Inventors: Hiroshi Sakamaki, Utsunomiya; Yukio Horikoshi, Kazo, both of Japan

[73] Assignee: Nippon Piston Ring Co., Ltd., Tokyo, Japan

[21] Appl. No.: 629,005

[22] Filed: Jul. 9, 1984

[30] Foreign Application Priority Data

Jul. 16, 1983 [JP] Japan ..... 58-128742

[51] Int. Cl.[4] ..... F04C 18/00; F04C 29/00

[52] U.S. Cl. ..... 418/173; 418/179

[58] Field of Search ..... 418/173, 178, 179, 152; 417/DIG. 1

[56] References Cited

U.S. PATENT DOCUMENTS

| | | | |
|---|---|---|---|
| 2,427,606 | 9/1947 | Johnson | 418/179 X |
| 3,552,895 | 1/1971 | Bayley | 418/178 |
| 3,745,854 | 7/1973 | Haag et al. | 418/179 X |
| 3,934,321 | 1/1976 | Iida et al. | 418/178 X |
| 4,464,101 | 8/1984 | Shibuya | 418/179 X |

FOREIGN PATENT DOCUMENTS

| | | | |
|---|---|---|---|
| 25501 | 2/1979 | Japan | 418/179 |
| 9687 | 1/1981 | Japan | 418/178 |
| 65988 | 4/1983 | Japan | 418/173 |
| 67989 | 4/1983 | Japan | 418/179 |

*Primary Examiner*—William L. Freeh
*Assistant Examiner*—Paul F. Neils
*Attorney, Agent, or Firm*—Birch, Stewart, Kolasch & Birch

[57] ABSTRACT

A vane-type rotary pump constructed such that a rotor, into and out of which a vane can freely move, is rotatably installed in the central housing. The rotor is rotatably supported through a bearing by side housings flanking the central housing on both sides, the side housings being composed of shaft housing parts to hold the bearing and of side plate parts on the rotor side. The shaft housing parts are fabricated of either an iron base material or a composite material of whisker fibers. The side plate parts are fabricated of either a light metal or a light alloy and the shaft housing parts and side plate parts are joined together integrally. The rotary pump of such a structure is characterized by reduced weight and improved durability.

12 Claims, 4 Drawing Figures

VANE-TYPE ROTARY PUMP HAVING TWO-PIECE SIDE HOUSINGS

BACKGROUND OF THE INVENTION

1. Field of the Invention

The present invention relates to a vane-type rotary pump, and more particularly to the structure of its side housing.

2. Description of the Prior Art

A conventional vane-type rotary pump is constructed such that a rotor is rotatably installed in the central housing, eccentric to the central housing; a vane is slidable in a vane groove provided in the rotor; a fluid is drawn into a work chamber constituted between the rotor and the central housing or between the rotor and a rotary sleeve installed in the central housing; and after being compressed or expanded, the fluid is exhausted.

Both ends of the central housing are flanked with side housings and the rotor is rotatably supported by these side housings through a bearing.

In a vane-type rotary pump of such a structure the side housings, which are usually fabricated of cast iron, have the drawback of being very heavy. Recently an attempt has been made to fabricate the entire housing of a light metal or a light alloy for the sake of achieving weight reduction.

However, when the side housings are fabricated of a light metal like aluminum or of a light alloy like an aluminum alloy or a magnesium alloy, the shaft housing to hold the bearing, which is required to be particularly strong, lacks strength and durability tends to become strained or deformed, raising the problem of having the ablity to support the rotor with high presicion.

SUMMARY OF THE INVENTION

The object of the present invention is to provide a rotary pump free from the above-mentioned problem, and which has side housings which are lighter than side housing wholly fabricated of cast iron and stronger than side housings wholly fabricated of light metals or light alloys.

To accomplish this object, in the vane-type rotary pump according to the present invention, the side housing consists of a shaft housing portion for holding the bearing and a side plate portion on the rotor side.

The shaft housing portion is made of an iron base material or composite material, while the side plate portion is made of a light weight metal or a light weight alloy, said two parts being integrated together.

Under such a structure, the strength of the shaft housing portion or part is equivalent to that of side housing which is entirely made of cast iron, and the weight of the side plate portion or part which accounts for a greater portion of the total weight of the side housing is, on account of the light metal or light alloy structure, substantially reduced as compared with the side housing wholly made of cast iron. Accordingly, the object of the present invention is accomplished.

BRIEF DESCRIPTION OF THE DRAWINGS

The above and other objects, features and advantages of the present invention will become apparent and more readily appreciated from the following detailed description of exemplary embodiments of the present invention, taken in conjunction with the accompanying drawings, wherein.

DETAILED DESCRIPTION OF THE PREFERRED EMBODIMENT

Figure 1:
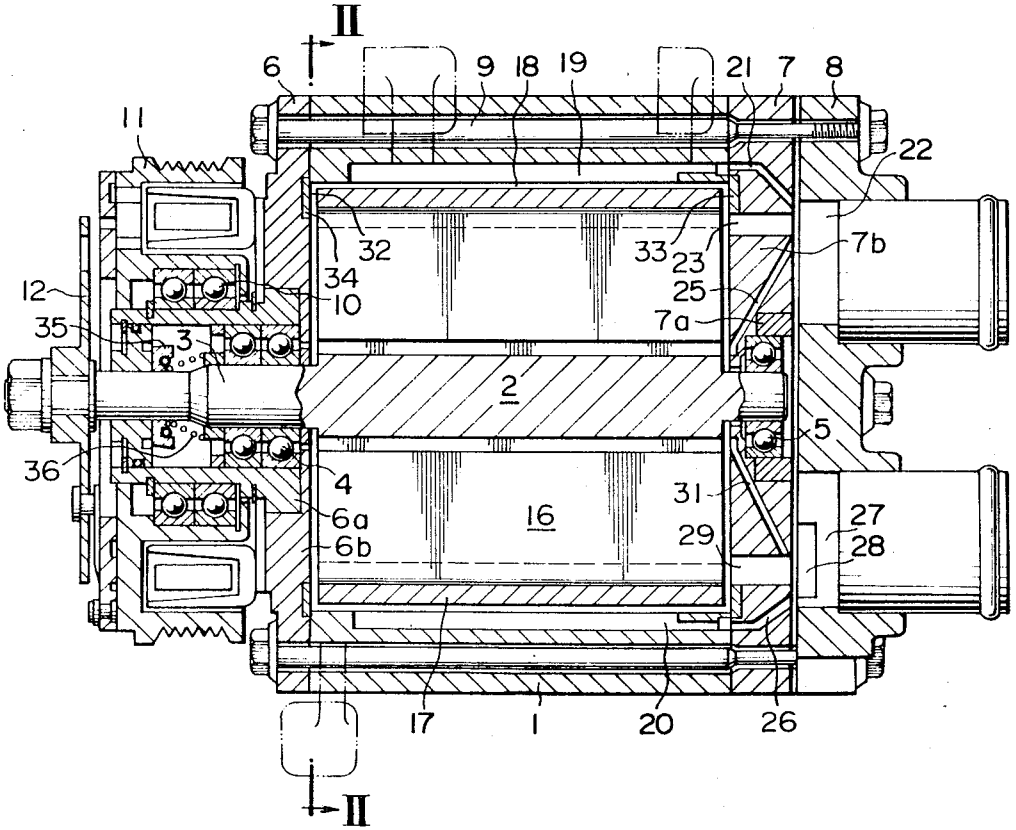
FIG. 1 is a sectional view of a rotary pump in one embodiment of the present invention.

Referring to the drawings, a preferred embodiment of the present invention is now to be described.

Figure 2:
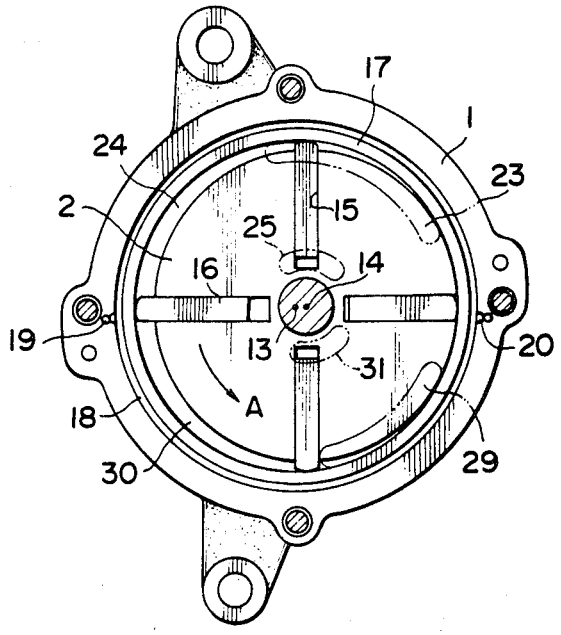
FIG. 2 is a sectional view taken along the line II—II of FIG. 1.
Figure 3:
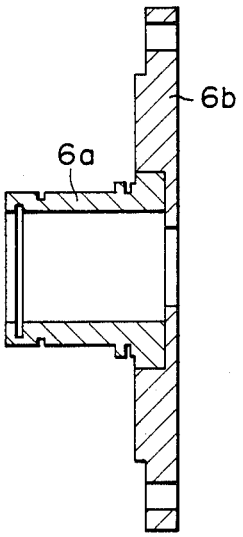
FIG. 3 is a sectional view of the front side of the side housings illustrated in FIG. 1.
Figure 4:
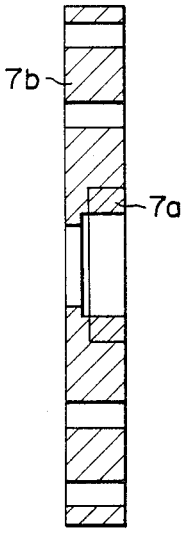
FIG. 4 is a sectional view of the rear side of the side housings illustrated in FIG. 1.

FIGS. 1 and 2 illustrate a rotary pump in one embodiment of the present invention. In these figures, 1 is the central housing and 2 is the rotor rotatably installed within the central housing 1. The rotor 2 is, at the rotating shaft 3 integrated thereto, rotatably supported through the bearings 4, 5 by the front side housing 6 and the rear side housing 7. The front side housing 6, the rear side housing 7 and the central housing 1 constitute the housing assembly. A bolt 9 which extends through the central housing 1 and the rear cover 8 provided outside of the rear side housing 7 fastens the front side housing 6 and the rear side housing 7 to the central housing 1. The rotating shaft 3 of the rotor 2 is connected via a rotatable member 12 to a pulley 11 which is rotatably supported via a bearing 10 by the front side housing 6.

A drive force is transmitted to the pulley 11 from a drive mechanism not shown, for example the crankshaft of an engine.

As seen from FIG. 2, the rotor 2 has its center 14 located at a position eccentric to the center 13 of the central housing 1. On the rotor 2 are formed a number of vane grooves 15 with a bottom. The grooves extend in the radial direction of the rotor 2 and open towards the inside surface of the central housing 1. The vane 16 can move freely into and out of the vane groove 15 in the radial direction of the rotor 2.

Between the vane 16 and the inside surface of the central housing 1 there is rotatably installed a rotary sleeve 17 consisting of an annular member having substantially the same center as the center 13 of the central housing 1. A clearance between the outside surface of the rotary sleeve 17 and the inside surface of the central housing 1 constitutes a pneumatic bearing chamber 18. The pneumatic bearing chamber 18 extends over the entire outside surface of the rotary sleeve 17 and thus the rotary sleeve 17 is floatingly suspended within the central housing 1 by means of the pneumatic bearing chamber 18. Into the pneumatic bearing chamber 18 opens a gas inlet 19 and a gas outlet 20 which are straight slits extending parallel to the axis of the rotary sleeve 17 and are provided on the inside surface of the central housing 1. The gas inlet 19 may be formed as a zigzag slit or an isosceles triangle with its apex pointing in the rotating direction. The gas inlet 19 communicates with a suction chamber 22 formed within the rear cover 8, via the gas supply hole 21 formed within the rear side housing 7.

The suction chamber 22 communicates with the suction side work chamber 24 located between the rotor 2 and the rotary sleeve 17, via the suction hole 23 formed within the rear side housing 7. The rotor side opening of hole 23 is in the form of an arc as illustrated in FIG. 2.

The suction chamber 22 communicates, via a communication hole 25 whose rotor side opens in the form of an arc, and with a space formed between the bottom of the vane groove 15 and the vane 16.

Meanwhile, the gas outlet 20 communicates with the exhaust chamber 27 formed within the rear cover 8, via the gas exhaust hole 26 provided within the rear side housing 7. The exhaust chamber 27 communicates via the exhaust valve 28 with the exhaust hole 29 provided within the rear side housing 7.

The exhaust hole 29, whose rotor side opens in the from of an arc, communicates with the exhaust side work chamber 30 located between the rotor 2 and the rotary sleeve 17; and also communicates, via a communication hole 31 whose rotor side opens in the form of an arc, with a space formed between the bottom of the vane groove 15 and the vane 16.

The gas inlet 19 and the gas outlet 20 are located, as indicated in FIG. 2, at the start and at the end of the exhaust side work area, respectively, as viewed from the rotor-driven direction A.

On the inside of the front side housing 6 and the rear side housing 7, and opposed to the ends of the rotary sleeve 17 there are provided annular grooves 32, 33 which open to the side of the rotary sleeve 17. To these grooves 32, 33 is fitted an annular non-lubricated slidable member 34. The slidable member 34 is fabricated of a self-lubricating carbon base material.

The front side housing 6 and the rear side housing 7 are divided into shaft housing parts *6a*, *7a* which respectively hold the bearings 4, 5 into side plate parts *6b*, *7b* which are located on the rotor side. The shaft housing part *6a* of the front housing 6 holds, in addition to the bearing 4 which rotatably supports the shaft 2, a sealing member 35 and a spring for pressing the sealing member 35. Around the shaft housing part *6a* there is fitted a bearing 10 which supports a pulley 11.

The shaft housing parts *6a*, *7a* of the front side housing 6 and the rear side housing 7 are fabricated of an iron base material or a composite material. The iron material is for example cast iron. The composite material is for example made of whisker fibers of an inorganic substance such as carbon, silicon carbide or glass, which does not melt at bath temperatures when the molten base material is poured.

To illustrate an example of manufacturing such whisker fiber material, whisker fibers are pressurized and molded to a maximum density of about 50%, yielding a blank for the shaft housing. The blank is placed in a metal mold, into which a molten metal of aluminum or an aluminum alloy or a magnesium alloy is poured to fill up the cavities in the whisker fibers of the blank, thus producing a whisker fiber composite material. When such a blank is further forged to make the shaft housing part, the resulting whisker fibers become alined, exhibiting the so-called "forged streamlines" with the strength very much increased.

On the contrary, the side plate parts *6b*, *7b* are made of a light metal or a light alloy. The light metal can be aluminum; the light alloys can be forgings or sinterings of an aluminum alloy or a magnesium alloy. On a whisker fiber composite material based on such metal or alloy may be employed. Whisker fibers in such a composite material can be, as mentioned above, made of silicon carbide, carbon, glass or other inorganic substances.

The shaft housing parts *6a*, *7a* and the side plate parts *6b*, *7b* thus manufactured are integrated. Integration is done by internal chilling, pressurizing or shrink-fitting. Internal chilling is preferable, because it is more reliable. When both the shaft housing parts *6a*, *7a* and the side plate parts *6b*, *7b* are made of whisker fiber composite material, the side housings 6, 7 may be produced by making, in advance, an integral blank of whisker fibers and impregnating said blank with a molten metal. Such a manufacturing process is also covered by the present invention.

Next, the action of a rotary pump thus constructed will be described. First, a drive force is transmitted from the engine to the pulley 11, and with a torque transmitted to the rotor 2 via the pulley 11, the rotatable member 12 and the rotating shaft 3, the rotor 2 begins to rotate. As the rotor 2 rotates, the centrifugal force pushes the vane 16 outward in the radial direction and as a consequence the vane 16 is pressed against the inside surface of the rotary sleeve 17.

With rotation of the rotor 2 and the vane 16, the gas is drawn from the suction chamber 22 via the suction hole 23 into the suction side work chamber 24. When the drawn gas reaches the exhaust side work chamber 30 with the rotation of the rotor 2, the gas is compressed in the gap between the rotor 2 and the inside surface of the rotary sleeve 17, because the gap is progressively narrowed in the driven direction A. The gas thus compressed is discharged from the exhaust chamber 27 via the exhaust hole 29.

Into the space between the vane 16 and the bottom of the vane groove 15 is introduced the gas through the communication hole 25 and then it is discharged through the communication hole 31, thereby helping the vane 16 smoothly reciprocate within the vane groove 15.

The rotary sleeve 17 begins to rotate together with the vane 16, when the sliding friction of the rotary sleeve 17 against the vane 16 becomes greater than the friction of the rotary sleeve 17 against the inside surface of the central housing 1. Whereupon the gas is drawn through the inlet 19 into the pneumatic bearing chamber 18, and the rotary sleeve 17 is floatingly suspended by the pneumatic bearing within the central housing 1. Then the friction between the rotary sleeve 17 and the central housing 1 drops drastically, making the rotation smooth.

Such rotation of the rotor 2 repeatedly imposes a heavy load on the shaft housing parts *6a*, *7a* of the side housings 6, 7 where the rotor 2 is supported. However, the shaft housing parts *6a*, *7a* in the present invention, which are fabricated of iron base or composite material, are so strong that they suffer no strain, no permanent deformation nor any cracking. In the rotary pump according to the present invention there is no possibility of strain or deformation, which, if it ever happened, would induce a rotational vibration or develop a fatigue under repeated loading in the rotor 2.

Meanwhile the weight of the side plate parts *6b*, *7b* on the outside surface, which accounts for a greater portion of the total weight of the side housings 6, 7, is, on account of the light metal or light alloy structure or mixed structure, substantially reduced as compared with side housings wholly made of iron. Therefore such a structure will have a great merit in application to the rotary pump as an auto part which must be constructed to be light.

In the above explanation a rotary pump equipped with a rotary sleeve is treated, but the same thing can be said about a rotary pump with no rotary sleeve and the present invention naturally covers such a rotary pump with no rotary sleeve.

As explained above, in the rotary pump according to the present invention the shaft housing parts of the side housings are fabricated of an iron base or composite material, while the side plate parts thereof are fabricated of a light metal or a light alloy, thereby ensuring the strength and durability of the shaft housing parts and at the same time reducing the weight of the rotary pump as a whole.

Although only preferred embodiments of the present invention has been described in detail, it will be appreciated by those skilled in the art that various modifications and alterations can be made to the particular embodiments shown without materially departing from the novel teachings and advantages of the invention. Accordingly, it is to be understood that all such modifications and alterations are included within the scope of the invention as defined by the following claims.

What is claimed is:

1. A vane-type rotary pump comprising:

a central housing;

a rotor rotatably installed within said central housing, said rotor having a vane which is free to move into or out of said rotor; and side housings flanking said central housing on both sides thereof, said side housings rotatably supporting said rotor by means of a bearing, said side housings having a light and strong construction and being composed of shaft housing parts for holding said bearing and side plate parts on the rotor side, said shaft housing parts being fabricated of a material selected from the group consisting of an iron base material and a whisker fiber composite material, said side plate parts being fabricated of a material selected from the group consisting of a light weight metal and a light weight metal alloy; and said shaft housing parts and said side plate parts being integrated together.

2. The vane-type rotary pump of claim 1, wherein said light weight metal is aluminum.

3. The vane-type rotary pump of claim 1, wherein said light weight alloy is an aluminum alloy or a magnesium alloy.

4. The vane-type rotary pump of claim 1, wherein said shaft housing parts and said side plate parts are joined together by an interference fit.

5. The vane-type rotary pump of claim 1, wherein said whisker fibers of said composite material are made of an inorganic substance.

6. The vane-type rotary pump of claim 5, wherein said inorganic substance is a fiber selected from the group consisting of silicon carbide, carbon and glass.

7. The vane-type rotary pump of claim 1, wherein a rotary sleeve is suspended by means of a pneumatic bearing chamber in said central housing, between said central housing and said rotor and said vane is at the outer end in slidable contact with said rotary sleeve.

8. The vane-type rotary pump of claim 7, wherein said iron base material is cast iron.

9. The vane-type rotary pump of claim 3, wherein said whisker fibers of said composite material are made of an inorganic substance.

10. The vane-type rotary pump of claim 2, wherein said light weight metal is aluminum.

11. The vane-type rotary pump of claim 2, wherein said light weight metal alloy is an aluminum alloy or a magnesium alloy.

12. The vane-type rotary pump of claim 2, wherein said shaft housing parts and said side plate parts are joined together by an interference fit.

* * * * *